US005562268A

United States Patent [19]

Bothner

[11] Patent Number: 5,562,268

[45] Date of Patent: Oct. 8, 1996

[54] YARN CUTTING ASSEMBLY FOR A RING SPINNING OR A YARN TWISTING SPINDLE

[75] Inventor: Jakob Bothner, Göppingen, Germany

[73] Assignee: Zinser Textilmaschinen GmbH, Ebersbach/Fils, Germany

[21] Appl. No.: 310,434

[22] Filed: Sep. 22, 1994

[30] Foreign Application Priority Data

Oct. 25, 1993 [DE] Germany ..... 43 36 359.8

[51] Int. Cl.[6] ..... B65H 54/71; D01H 9/14

[52] U.S. Cl. ..... 242/19; 242/48; 57/278; 57/303

[58] Field of Search ..... 242/19, 18 R, 242/18 EW, 48; 57/129, 130, 276, 277, 278, 303

[56] References Cited

U.S. PATENT DOCUMENTS

| | | | |
|---|---|---|---|
| 3,210,922 | 10/1965 | Winter | 57/303 X |
| 3,530,657 | 9/1970 | Grau | 242/18 R X |
| 3,967,440 | 7/1976 | Narumi et al. | 57/303 |
| 4,151,706 | 5/1979 | Brooks | 57/299 X |
| 4,942,730 | 7/1990 | Morrison | 57/303 |

FOREIGN PATENT DOCUMENTS

| | | | |
|---|---|---|---|
| 0278561 | 8/1988 | European Pat. Off. . | |
| 4015707 | 11/1991 | Germany . | |
| 4101824 | 7/1992 | Germany | 57/277 |
| 596671 | 3/1978 | U.S.S.R. | 57/303 |

*Primary Examiner*—Daniel P. Stodola
*Assistant Examiner*—Michael R. Mansen
*Attorney, Agent, or Firm*—Herbert Dubno; Dyuri Kateshov

[57] ABSTRACT

Frustoconical portions of a blade blank are ground only along their external periphery so that the grounds are cylindrical. The frustoconical portion form openings as well as of 20° to 30° with the generatrix of the cylinder. The blades can be ground a number at a time in the form of a stack with the disk portion. The resulting blades are mounted on the spindles of a ring spinning or ring twisting machine to cut the threads to turn the last thread on spool or bobbin and lower turns on a collecting region of the respective spindle.

5 Claims, 3 Drawing Sheets

YARN CUTTING ASSEMBLY FOR A RING SPINNING OR A YARN TWISTING SPINDLE

FIELD OF THE INVENTION

The present invention relates to a yarn cutter for a spinning or twisting machine and more particularly, to a ring spinning or a twisting spindle. More particularly this invention relates to a thread cutting assembly of a ring spinning or ring twisting spindle which has a yarn cutting blade with a frustoconical periphery, at the lower edge of which the blade is sharpened by grinding only along its outer side.

BACKGROUND OF THE INVENTION

A thread cutting device is disclosed German Patent Document DE 40 15 707 C2 which has a yarn cutting blade disposed between the core-sleeve receiving portion of the spindle and a yarn-collecting region, e.g. a knurled cylindrical portion, below the spindle. This blade has a downwardly extending edge radially spaced from the spindle and on a frustoconical portion of the blade.

In practice, after the last turns of the yarn are wound on the bobbin or spool formed on the core sleeve by control of the ring rail so that these turns will not loosen, and prior to doffing of the bobbin or spool, the ring rail of the spinning or twisting machine is controlled to wind two or more turns on the yarn collecting cylindrical portion of the spindle below the blade, so that the yarn will be located against the blade between the last turns on the spool or bobbin and the turns wound on the yarn-collecting region.

When the bobbin or spool is then removed from the spindle, e.g. by an automatic bobbin or spool removal or doffer, the yarn strand lying against the blade is severed by a cutting edge thereof.

The fabrication of such a blade is costly and time consuming. The frustoconical region has an open angle of 45° (complement to the angle of the frustocone or the angle included between a generatrix of the outer surface of the cone and a line parallel to the axis of the spindle and of the blade, i.e. a vertical in most cases). The cutting edge can then be ground at 30° to leave an angle of 15°. Because of this very special configuration, the blades must be mounted individually and equally along both the inner and outer sides of the frustoconical apron. Frequently, the blades do not function fully satisfactorily when individually ground in this manner.

OBJECTS OF THE INVENTION

It is, therefore, the principal object of the present invention to provide an improved yarn cutting blade for a system of the type described which will be less expensive to fabricate and more reliable in its cutting operation.

Another object of the invention is to provide an improved yarn-cutting assembly for a ring spinning or ring twisting machine whereby drawbacks of earlier assemblies are obviated.

It is also an object of this invention to provide an improved method of making the cutting blades whereby the grinding thereof is simplified and, for example, a multiplicity of such blades can be ground simultaneously.

A further object of this invention is to provide a stack of such blades as a workpiece in such fashion as to enable the simultaneous grinding of the portions of the blades which form the cutting edge.

SUMMARY OF THE INVENTION

These objects and others which will become apparent hereinafter are attained, in accordance with the invention by providing the ground surface of the blade so that it lies along a cylinder or imaginary cylindrical surface and the frustoconical portion has an open angle as defined above of 20° to 30°.

This affords the advantage that a multiplicity of blade members can be assembled into a stack and ground together to obtain thereby an angle at the cutting edge of 30° to 20°. The result is a significant reduction in the fabrication cost.

According to a feature of the invention, the blade has a mounting region which can be seated upon the spindle and a frustoconical portion which can extend downwardly and outwardly therefrom. The mounting region is disposed at a right angle to the spindle axis and has an opening to receive the spindle in a disk plane. At the periphery of the disk, the frustoconical region is formed.

This configuration of the blade simplifies its fabrication. For example, the fabrication process can include the steps of stamping out an annular disk of an appropriate steel strip or sheet, bending the outer edge of the annular disk to form the frustoconical region, hardening the resulting blade blank, assembling the blade blanks into a stack and peripherally grinding the stack to a cylindrical with the respective cylindrical bands of successful blanks being flush with one another in the axial direction. The grinding can be effected with a grinding wheel or drum.

To insure that the blade blanks contact one another only over a limited portion of their overlapping frustoconical regions, spacers can be formed on the disk in the region of the mounting portion. These spacers can be bulges, noses which are bent out of the plane of the disk in the region of the opening, or other formations. Spacer regions can also be interposed between the blade blanks as desired.

In forming the stack, only a limited portion of the inner wall of the frustocone of one blade blank will rest upon the outer wall of a neighboring blade blank as a result of the mutual spacing of the mounting regions of the blade blanks. The height of the spacer determines the degree of overlap of the frustoconical regions and hence the axial width of the ground surfaces.

The invention thus includes a yarn cutting assembly comprising:

- a spindle for a spinning or twisting machine having a core-sleeve receiving portion;
- a yarn-turn collecting region spaced below the receiving portion; and
- a yarn-cutting blade mounted between the core-sleeve receiving portion and the region for severing a yarn between turns wound on a core sleeve and turns wound on the region, the blade comprising:
  - a disk mounted on the spindle,
  - a downwardly turned outwardly divergent frustoconical portion connected to the disk and including an angle $\alpha$ with a line parallel to an axis of the spindle, where $20° \leqq \alpha \leqq 30°$, and
  - a ground surface on the frustoconical portion forming a lower cutting edge where the ground surface meets an unground frustoconical surface on an underside of the blade, the ground surface lying along a cylinder having the axis of the spindle as the axis of the cylinder.

The stack forms a workpiece which can be ground to make a plurality of yarn cutters and can comprise a stack of nested blades each having a disk for mounting on a respective spindle and a frustoconical portion attached to the respective disk, and spacers between the disks so that each frustoconical portion overlaps only a limited part of a frustoconical portion of an adjacent blade inwardly thereof, whereby edge zones of each frustoconical portion are exposed along an outer periphery of the stack.

The method of making the yarn cutter can comprise the steps of:

stamping a plurality of annular blades from sheet steel with respective disks for mounting upon a respective spindle, and a frustoconical portion connected to each disk;

stacking and nesting the blades in a workpiece comprising a stack of nested blades with spacers between the disks so that each frustoconical portion overlaps only a limited part of a frustoconical portion of an adjacent blade inwardly thereof, whereby edge zones of each frustoconical portion are exposed along an outer periphery of the stack; and grinding the edge zones of the stack to form respective ground surfaces lying along a right circular cylinder and meeting unground inner surfaces of the frustoconical portions along respective cutting edges of the blades.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
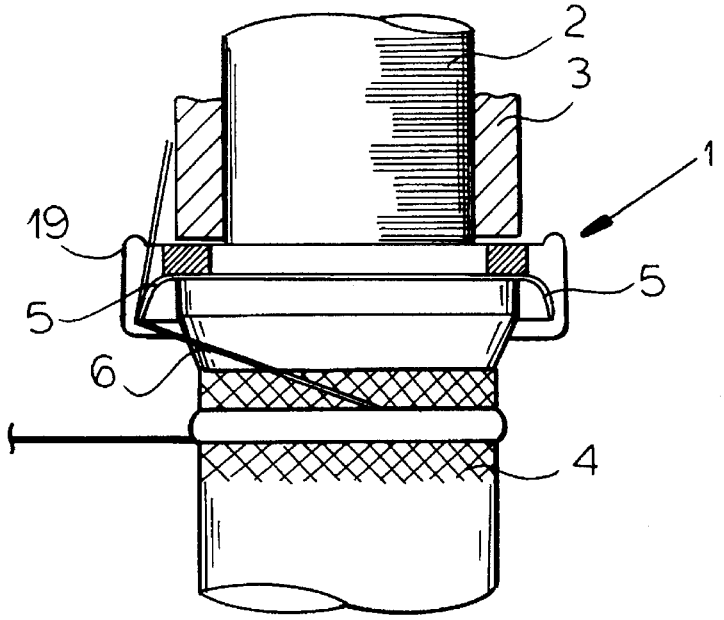
FIG. 1 is a schematic side elevational view of a yarn cutting assembly according to the invention.

As seen in FIG. 1, I have shown a thread cutting assembly 1 for each of the stations of a ring spinning or ring twisting machine at the respective spindle 2 thereof. As can be seen from FIG. 1, a core sleeve 3 can be mounted on the spindle and the core sleeve receiving portion thereof and below that sleeve 3 is a lower winding region 4 which is knurled and has been shown only schematically, but serves as a collecting region for two or more turns of the yarn 6 as it is wound on this region following the winding of the spool or bobbin on the sleeve 3. Below the sleeve 3 and above this region 4 is a yarn cutting blade 5 below a cover 19 which, as in the aforementioned patent, can be provided with notches or openings through which the thread 6 can pass to engage the blade. The blade 5 is positioned to sever the thread 6 which is held tightly between the least turns on the sleeve 3 and the turns on the yarns collecting region 4 when the spool or bobbin is removed from the spindle in the manner previously described and in the aforementioned patent.

Figure 2:
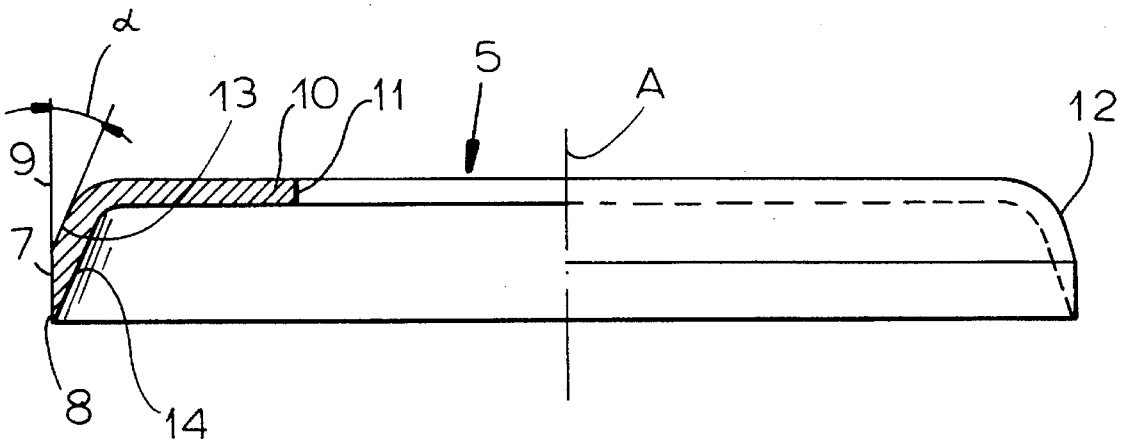
FIG. 2 is a side elevational view of the blade of FIG. 1 drawn to a larger scale and partly in section.

FIG. 2 shows the blade 5 to a larger scale and partly broken away. As can be seen here, the blade 5 has a support region 10 in the form of a generally flat disk lying perpendicular to the axis A of the blade and corresponding to the spindle axis. The support region 10 is provided with an opening 11 to receive the spindle and the planar disk portion 10 lies generally in a horizontal plane.

Connected to the disk portion 10 along its outer portion for a frustoconical region 12 having a downwardly open cup shape and downwardly and outwardly divergent. The frustoconical cup 12 is externally ground at 7 to conform to a cylinder, a generatrix of which is represented at 9 and is parallel to the axis A. The blade is ground only along this external side of the frustoconical cup and the ground surface 7 meets the outwardly divergent frustoconical inner wall 14 in a cutting edge 8.

Between the outer wall 13 of the frustoconical cup and the generatrix 9, an open angle $\alpha$ is defined which ranges from 20° to 30°.

Figure 5:
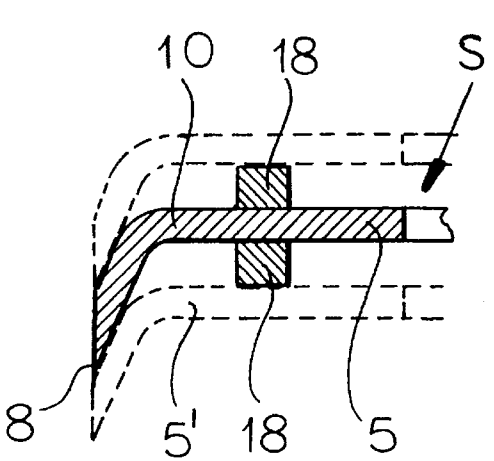
FIG. 5 is a cross sectional view of a third embodiment of spacers in the stacking of the blade blanks according to the invention.
Figure 4:
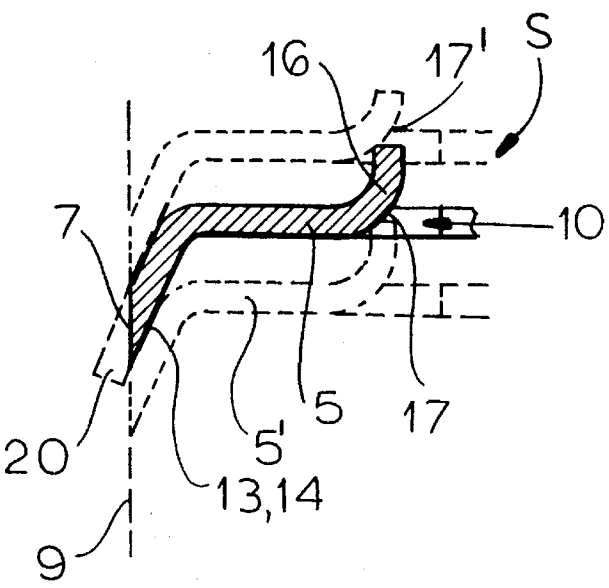
FIG. 4 is a cross sectional view of a second embodiment of spacers in the stacking of the blade blanks according to the invention.
Figure 3:
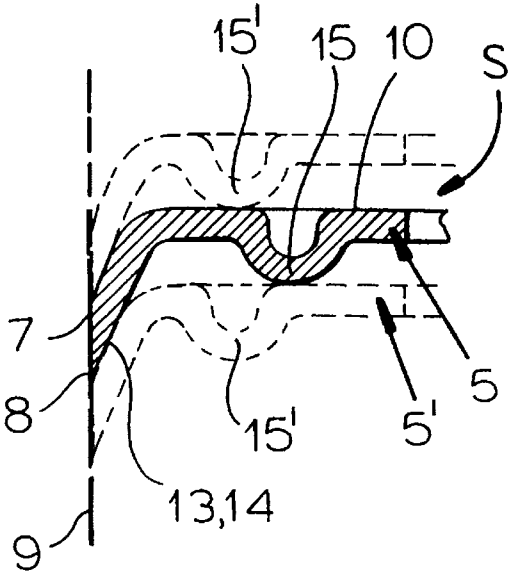
FIG. 3 is a cross sectional view of a first embodiment of spacers in the stacking of the blade blanks according to the invention.
Figure 6:
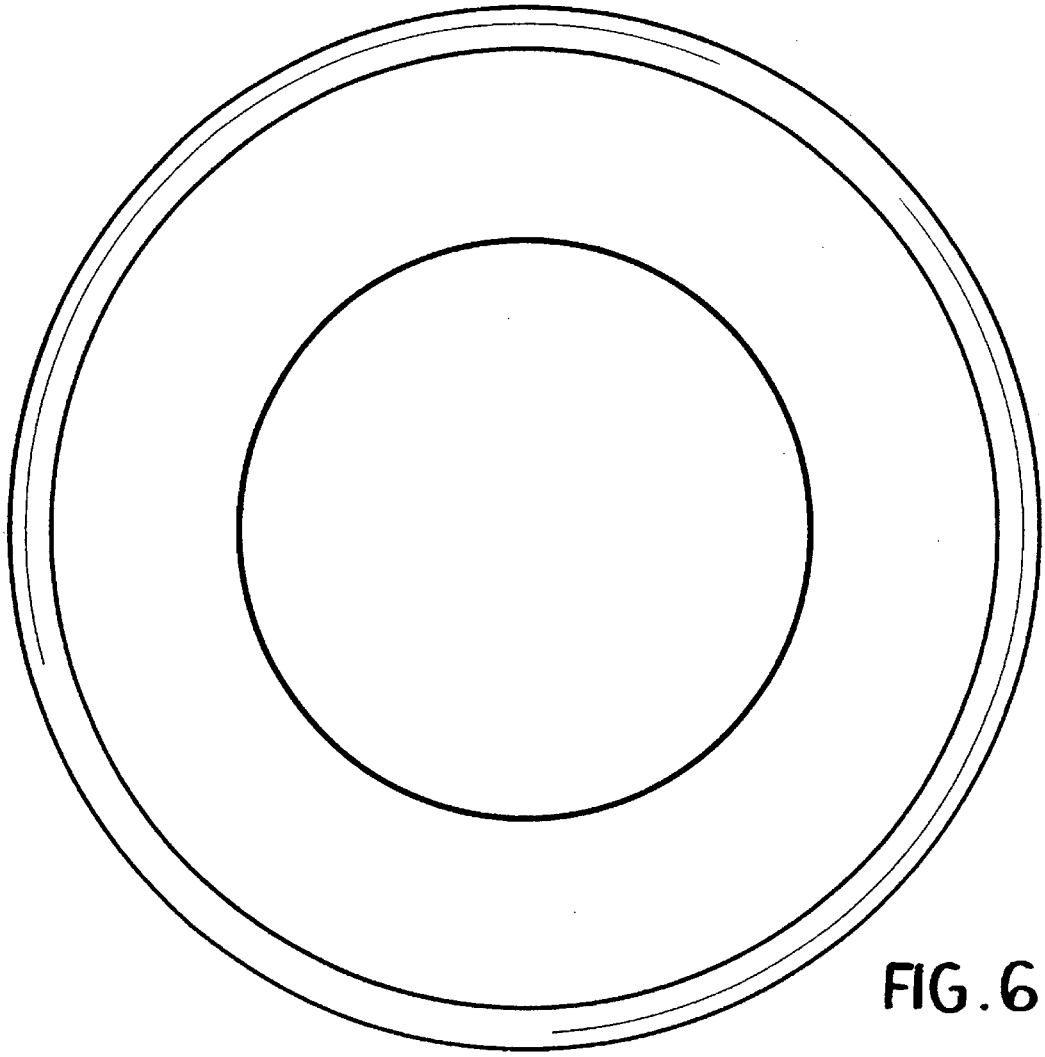
FIG. 6 is a plan view of the blade of FIGS. 1 and 2.

To permit grinding of the surface 7, the blade blanks can be stacked as shown in FIGS. 3, 4 and 5 with spacers between the mounting regions 10 thereof. In each of these FIGS., blade blanks 5' which are neighboring the stack are held apart by, for example, rounded portions 15 or 15' which maybe offset from one another laterally in successful blanks as shown in FIG. 3. Instead of these bulges, tongues or noses 16 may be bent upwardly along the periphery of the opening 11 to engage the underside 17, 17' of the projection of the tongue or nose of a neighboring blade blank as shown in FIG. 4.

In FIGS. 3 and 4, the spacers are integral with the blade blanks and can be formed by stamping or the like or by bending at the same time that the frustoconical portion is formed.

FIG. 5 shows that it is possible to provide spacers in the form of independent spacer rings 18. In all three cases, after the flat disk is stamped from steel strip, the frustoconical portion and, if desired, spacer portions are formed on this ring to provide the blanks 5 and 5'. The latter are the stacked as shown in FIGS. 3 through 5 and the stack is peripherally ground to form the cylindrical surfaces 7 defining the respective cutting edges 8. The grinding can be effected by a grinding wheel or drum (not shown). In a single grinding process, a plurality of blades can be formed.

Figure 7:
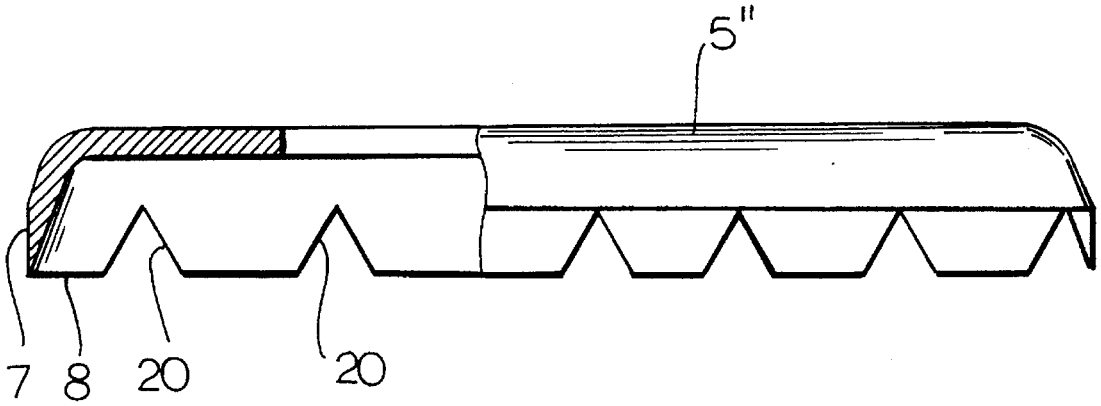
FIG. 7 is a view similar to FIG. 2 but illustrating another embodiment.

It is possible to provide the blades with V-shaped notches which can be ground into them as represented at 20 for the blade 5" shown in FIG. 7. The notches along the periphery of the blade can also correspond, if desired, to the notch configurations of the aforementioned patent.

When the blades are ground as has been described as with FIGS. 3 to 5, the stack is disassembled and the individual blades mounted on the respective spindles.

I claim:

1. A yarn-cutting assembly comprising:

a spindle for a textile machine having a core-sleeve receiving portion;

a yarn-turn collecting region spaced below said receiving portion; and a yarn-cutting blade mounted between said core-sleeve receiving portion and said region for severing a yarn between turns wound on a core sleeve and turns wound on said region, said blade comprising:

a disk mounted on said spindle, a downwardly turned outwardly divergent frustoconical portion connected to said disk, said frustoconical portion including an angle $\alpha$ with a line parallel to an axis of the spindle, where $20° \leqq \alpha \leqq 30°$, and a ground surface on said frustoconical portion forming a lower cutting edge where said ground surface meets an unground frustoconical surface on an underside of the blade, said ground surface lying along a cylinder having the axis of said spindle as the axis of the cylinder.

2. The yarn-cutting assembly defined in claim 1 wherein said disk has a flat annular portion perpendicular to said axis of said spindle and formed with an opening by which said blade is connected to said spindle, said annular portion extending to said frustoconical portion.

3. The yarn-cutting assembly defined in claim 2, further comprising formations formed on said annular portion.

4. The yarn-cutting assembly defined in claim 2 wherein said yarn cutting blade is composed of steel.

5. The yarn-cutting assembly defined in claim 2 wherein said frustoconical portion is provided with V-shaped notches along a periphery thereof.

* * * * *